US010648353B2

(12) United States Patent
Aggarwala et al.

(10) Patent No.: US 10,648,353 B2
(45) Date of Patent: May 12, 2020

(54) LOW LOSS AIRFOIL PLATFORM RIM SEAL ASSEMBLY

(71) Applicant: United Technologies Corporation, Hartford, CT (US)

(72) Inventors: Andrew S. Aggarwala, Vernon, CT (US); Russell J. Bergman, Windsor, CT (US); Mark A. Boeke, Plainville, CT (US); Kyle C. Lana, Portland, CT (US); Daniel A. Snyder, Manchester, CT (US)

(73) Assignee: United Technologies Corporation, Farmington, CT (US)

( * ) Notice: Subject to any disclaimer, the term of this patent is extended or adjusted under 35 U.S.C. 154(b) by 830 days.

(21) Appl. No.: 14/942,484

(22) Filed: Nov. 16, 2015

(65) Prior Publication Data

US 2016/0153304 A1 Jun. 2, 2016

Related U.S. Application Data

(60) Provisional application No. 62/080,767, filed on Nov. 17, 2014.

(51) Int. Cl.

| | |
|---|---|
| ***F01D 11/02*** | (2006.01) |
| ***F01D 11/00*** | (2006.01) |
| ***F01D 5/22*** | (2006.01) |

(52) U.S. Cl.

CPC ..... *F01D 11/006* (2013.01); *F01D 5/22* (2013.01); *F01D 11/001* (2013.01); *F01D 11/02* (2013.01)

(58) Field of Classification Search

None

See application file for complete search history.

(56) References Cited

U.S. PATENT DOCUMENTS

| | | | | |
|---|---|---|---|---|
| 4,648,792 A | | 3/1987 | Baran, Jr. et al. | |
| 4,725,199 A | | 2/1988 | Johnson | |
| 4,820,119 A | | 4/1989 | Joyce | |
| 5,358,374 A | * | 10/1994 | Correia | F01D 5/081 415/115 |

(Continued)

FOREIGN PATENT DOCUMENTS

| | | |
|---|---|---|
| FR | 3001493 | 8/2014 |

OTHER PUBLICATIONS

EP search report for EP15194006.1 dated Apr. 1, 2016.

*Primary Examiner* — Kayla Mccaffrey

(74) *Attorney, Agent, or Firm* — Getz Balich LLC

(57) ABSTRACT

An airfoil stage of a turbine engine includes an upstream airfoil assembly, a downstream airfoil assembly in rotational relationship to the upstream airfoil assembly and a rim seal assembly integrated therebetween. The rim seal assembly may include a sloped downstream portion of a platform of the upstream airfoil assembly, an upstream segment of a platform of the downstream airfoil assembly and a nub that projects radially outward from the upstream segment. The downstream portion and the upstream segment are spaced from one-another defining a cooling cavity therebetween for the flow of cooling air. The portion and segment overlap axially such that the nub is axially aligned to the downstream portion for improved cooling effectiveness and a reduction of core airflow into the cooling cavity.

10 Claims, 5 Drawing Sheets

(56) References Cited

U.S. PATENT DOCUMENTS

| | | | | |
|---|---|---|---|---|
| 5,429,478 | A * | 7/1995 | Krizan | F01D 11/001 415/115 |
| 7,249,928 | B2 * | 7/2007 | Klasing | F01D 5/143 415/115 |
| 8,356,975 | B2 | 1/2013 | Grover et al. | |
| 8,562,285 | B2 | 10/2013 | McCaffrey et al. | |
| 8,562,286 | B2 | 10/2013 | Gleiner et al. | |
| 8,740,554 | B2 | 6/2014 | Virkler et al. | |
| 8,757,974 | B2 | 6/2014 | Propheter-Hinckley et al. | |
| 9,010,122 | B2 | 4/2015 | Bangerter et al. | |
| 9,188,017 | B2 | 11/2015 | Xu | |
| 2004/0033132 | A1 | 2/2004 | Iacopetti | |
| 2008/0145216 | A1 | 6/2008 | Klasing et al. | |
| 2010/0119364 | A1 * | 5/2010 | Bunker | F01D 11/001 415/199.5 |
| 2013/0224014 | A1 * | 8/2013 | Aggarwala | F01D 5/143 415/220 |
| 2013/0224026 | A1 | 8/2013 | Piersall et al. | |
| 2013/0294897 | A1 * | 11/2013 | Grover | F01D 11/001 415/173.7 |
| 2015/0369130 | A1 | 12/2015 | Suciu et al. | |

* cited by examiner

LOW LOSS AIRFOIL PLATFORM RIM SEAL ASSEMBLY

This application claims priority to U.S. Patent Appln. No. 62/080,767 filed Nov. 17, 2014, which is hereby incorporated by reference.

BACKGROUND

The present disclosure relates to a gas turbine engine, and more particularly, to a platform rim seal assembly of an airfoil stage.

Gas turbine engines are rotary-type combustion turbine engines built around a power core made up of a compressor, combustor and turbine, arranged in flow series with an upstream inlet and downstream exhaust. The compressor section compresses air from the inlet, which is mixed with fuel in the combustor and ignited to generate hot combustion gas. The turbine section extracts energy from the expanding combustion gas, and drives the compressor section via a common shaft. Expanded combustion products are exhausted downstream, and energy is delivered in the form of rotational energy in the shaft, reactive thrust from the exhaust, or both.

Gas turbine engines provide efficient, reliable power for a wide range of applications in aviation, transportation and industrial power generation. Small-scale gas turbine engines typically utilize a one-spool design, with co-rotating compressor and turbine sections. Larger-scale combustion turbines including jet engines and industrial gas turbines (IGTs) are generally arranged into a number of coaxially nested spools. The spools operate at different pressures, temperatures and spool speeds, and may rotate in different directions.

Individual compressor and turbine sections in each spool may also be subdivided into a number of stages, formed of alternating rows of rotor blade and stator vane airfoils. The airfoils are shaped to turn, accelerate and compress the working fluid flow, or to generate lift for conversion to rotational energy in the turbine.

Industrial gas turbines often utilize complex nested spool configurations, and deliver power via an output shaft coupled to an electrical generator or other load, typically using an external gearbox. In combined cycle gas turbines (CCGTs), a steam turbine or other secondary system is used to extract additional energy from the exhaust, improving thermodynamic efficiency. Gas turbine engines are also used in marine and land-based applications, including naval vessels, trains and armored vehicles, and in smaller-scale applications such as auxiliary power units.

Aviation applications include turbojet, turbofan, turboprop and turboshaft engine designs. In turbojet engines, thrust is generated primarily from the exhaust. Commercial fixed-wing aircraft generally employ turbofan and turboprop configurations, in which the low pressure spool is coupled to a propulsion fan or propeller. Turboshaft engines are employed on rotary-wing aircraft, including helicopters, typically using a reduction gearbox to control blade speed. Unducted (open rotor) turbofans and ducted propeller engines also known, in a variety of single-rotor and contra-rotating designs with both forward and aft mounting configurations.

Modern aircraft engines generally utilize two and three-spool gas turbine configurations, with a corresponding number of coaxially rotating turbine and compressor sections. In two-spool designs, the high pressure turbine drives a high pressure compressor, forming the high pressure spool or high spool. The low-pressure turbine drives the low spool and fan section, or a shaft for a rotor or propeller. In three-spool engines, there is also an intermediate pressure spool. Aviation turbines are also used to power auxiliary devices including electrical generators, hydraulic pumps and elements of the environmental control system, for example using bleed air from the compressor or via an accessory gearbox.

Turbofan engines are commonly divided into high and low bypass configurations. High bypass turbofans generate thrust primarily from the fan, which accelerates airflow through a bypass duct oriented around the engine core. This design is common on commercial aircraft and transports, where noise and fuel efficiency are primary concerns. The fan rotor may also operate as a first stage compressor, or as a pre-compressor stage for the low-pressure compressor or booster module. Variable-area nozzle surfaces can also be deployed to regulate the bypass pressure and improve fan performance, for example during takeoff and landing. Advanced turbofan engines may also utilize a geared fan drive mechanism to provide greater speed control, reducing noise and increasing engine efficiency, or to increase or decrease specific thrust.

Low bypass turbofans produce proportionally more thrust from the exhaust flow, generating greater specific thrust for use in high-performance applications including supersonic jet aircraft. Low bypass turbofan engines may also include variable-area exhaust nozzles and afterburner or augmentor assemblies for flow regulation and short-term thrust enhancement. Specialized high-speed applications include continuously afterburning engines and hybrid turbojet/ramjet configurations.

Gas turbine engines, such as those that power modern commercial and military aircraft, include a fan section to propel the aircraft, a compressor section to pressurize a supply of air from the fan section, a combustor section to burn a hydrocarbon fuel in the presence of the pressurized air, and a turbine section to extract energy from the resultant combustion gases and generate thrust. Typically for military aircraft and downstream of the turbine section, an augmentor section, or "afterburner," is operable to selectively increase the thrust. The increase in thrust is produced when fuel is injected into the core exhaust gases downstream of the turbine section and burned to generate a second combustion.

Across these applications, turbine performance depends on the balance between higher pressure ratios and core gas path temperatures, which tend to increase efficiency, and the related effects on service life and reliability due to increased stress and wear. This balance is particularly relevant for airfoil components in the hot sections of the compressor and turbine, where advanced cooling configurations and thermal coating systems are utilized in order to improve airfoil performance.

The turbine section typically includes alternating rows of turbine vanes and turbine blades. The turbine vanes are stationary and function to direct the hot combustion gases that exit the combustor section. The vanes and blades each project from respective platforms that when assembled form vane and blade rings. The vane and blade rings each have rims that generally oppose one another and define at least in-part a cooling cavity therebetween.

Due to the relatively high temperatures of the combustion gases, various cooling techniques are employed to cool the turbine vanes and blades. One technique involves the flow of cooling or purge air through the cavity located in-part between the blade and vane rings to cool adjacent components. Improvements in cooling effectiveness is desirable.

SUMMARY

An airfoil stage of a turbine engine according to one, non-limiting, embodiment of the present disclosure includes an upstream airfoil assembly defined about an axis and including a first platform having a downstream portion carrying a surface facing radially outward, and defining in-part a core flowpath, and wherein the surface slopes radially inward as the downstream portion projects downstream to a distal end of the downstream portion; and a downstream airfoil assembly disposed axially adjacent to the upstream airfoil assembly, the downstream airfoil assembly including a second platform having an upstream segment projecting upstream and a nub projecting radially outward from the upstream segment; and wherein the nub is axially aligned radially inward from the downstream portion.

Additionally to the foregoing embodiment, the nub is spaced radially inward from the downstream portion.

In the alternative or additionally thereto, in the foregoing embodiment, the nub is disposed axially upstream from the distal end.

In the alternative or additionally thereto, in the foregoing embodiment, the upstream airfoil assembly is a vane assembly and the downstream airfoil assembly is a blade assembly.

In the alternative or additionally thereto, in the foregoing embodiment, the upstream airfoil assembly is a blade assembly and the downstream airfoil assembly is a vane assembly.

In the alternative or additionally thereto, in the foregoing embodiment, the upstream and downstream airfoil assemblies are in rotational movement to one-another.

In the alternative or additionally thereto, in the foregoing embodiment, the downstream portion and the upstream portion generally define, at least in-part, a cavity for the flow of cooling air into the core flowpath.

In the alternative or additionally thereto, in the foregoing embodiment, the surface has at least in-part a convex contour.

In the alternative or additionally thereto, in the foregoing embodiment, the upstream segment carries a face facing radially outward, spaced from the downstream portion, having at least in-part a concave contour, and wherein the nub projects radially outward from the face.

In the alternative or additionally thereto, in the foregoing embodiment, the upstream segment carries a face facing radially outward, spaced from the downstream portion, and wherein the nub projects radially outward from the face.

In the alternative or additionally thereto, in the foregoing embodiment, the upstream airfoil assembly includes an airfoil projecting radially outward from the first platform and disposed upstream from the downstream portion, and the downstream airfoil assembly includes an airfoil projecting radially outward from the second platform and disposed downstream from the upstream segment.

A rim seal assembly of an airfoil stage for a gas turbine engine according to another, non-limiting, embodiment includes a platform downstream portion disposed about an engine axis and carrying a surface defining in-part a core flowpath; a platform upstream segment spaced from the platform downstream portion and axially overlapping at least in-part the platform downstream portion; and a nub projecting radially outward from the platform upstream segment and toward the platform downstream portion.

Additionally to the foregoing embodiment, the surface at the platform downstream portion slopes radially inward as the platform downstream portion projects downstream.

In the alternative or additionally thereto, in the foregoing embodiment, the platform upstream segment projects upstream to a distal end spaced radially inward from the platform downstream portion.

In the alternative or additionally thereto, in the foregoing embodiment, the platform upstream segment carries a face facing radially outward and the nub projects radially outward from the face.

In the alternative or additionally thereto, in the foregoing embodiment, the nub is proximate to the distal end.

In the alternative or additionally thereto, in the foregoing embodiment, the nub is circumferentially continuous about the axis.

In the alternative or additionally thereto, in the foregoing embodiment, the face has at least in-part a concave contour.

In the alternative or additionally thereto, in the foregoing embodiment, the surface has at least in-part a convex contour.

In the alternative or additionally thereto, in the foregoing embodiment, a cooling cavity is defined at least in-part between the platform downstream portion and the platform upstream segment.

The foregoing features and elements may be combined in various combination without exclusivity, unless expressly indicated otherwise. These features and elements as well as the operation thereof will become more apparent in light of the following description and the accompanying drawings. It should be understood, however, the following description and figures are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
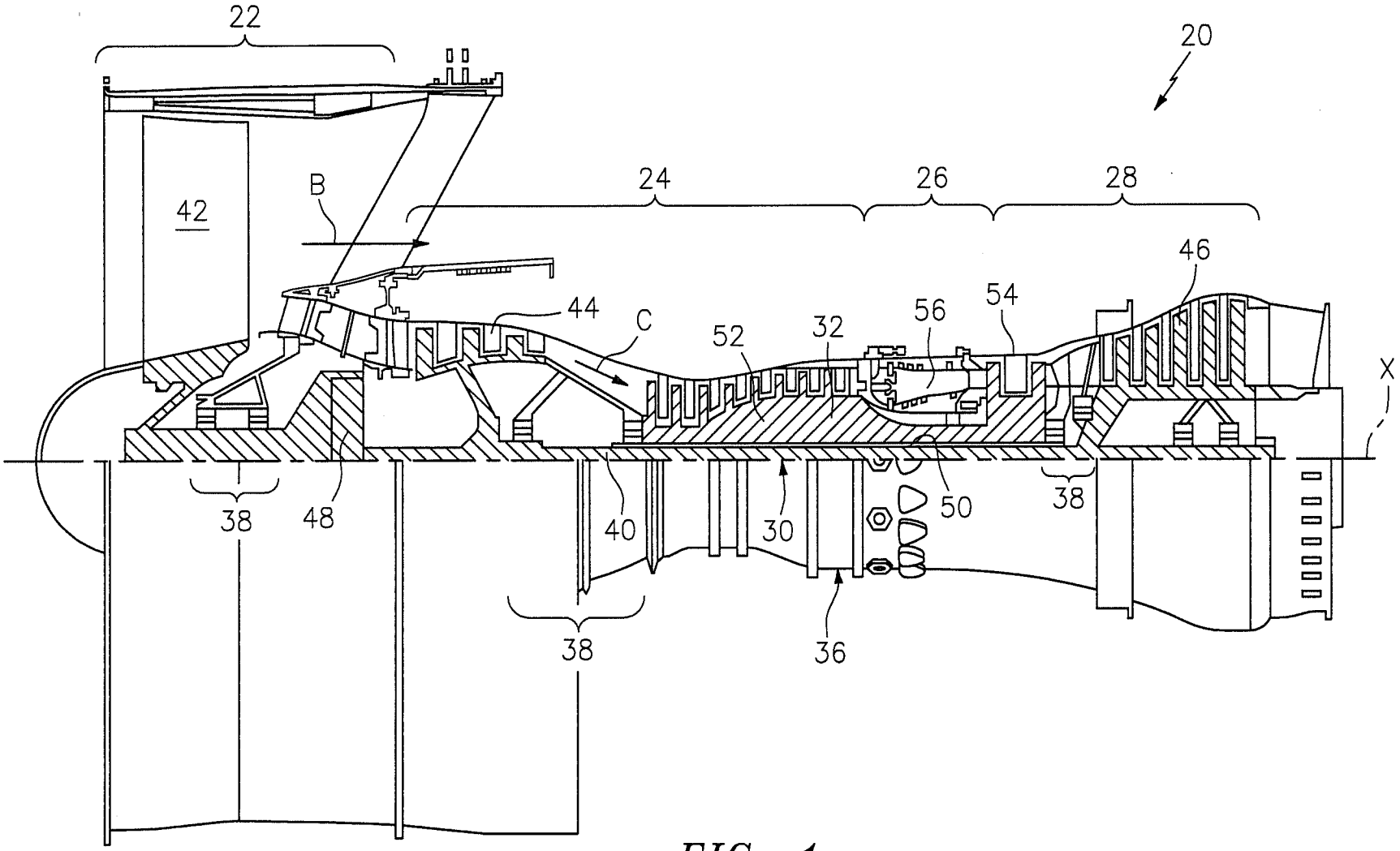
FIG. 1 is a schematic cross section of an exemplary gas turbine engine.

FIG. 1 schematically illustrates a gas turbine engine 20 disclosed as a two-spool turbo fan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26, then expansion through the turbine section 28. Although depicted as a turbofan in the disclosed non-limiting embodiment, it should be understood that the concepts described herein are not limited to use with turbofans as the teachings may be applied to other types of turbine engine architecture such as turbojets, turboshafts, and three-spool (plus fan) turbofans with an intermediate spool.

The engine 20 generally includes a low spool 30 and a high spool 32 mounted for rotation about an engine central longitudinal axis X relative to an engine static structure 36 or engine case via several bearing structures 38. The low spool 30 generally includes an inner shaft 40 that interconnects a fan 42 of the fan section 22, a low pressure compressor 44 ("LPC") of the compressor section 24 and a low pressure turbine 46 ("LPT") of the turbine section 28. The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") of the compressor section 24 and high pressure turbine 54 ("HPT") of the turbine section 28. A combustor 56 of the combustor section 26 is arranged between the HPC 52 and the HPT 54. The inner shaft 40 and the outer shaft 50 are concentric and rotate about the engine axis X. Core airflow is compressed by the LPC 44 then the HPC 52, mixed with the fuel and burned in the combustor 56, then expanded over the HPT 54 and the LPT 46. The LPT 46 and HPT 54 rotationally drive the respective low spool 30 and high spool 32 in response to the expansion.

In one non-limiting example, the gas turbine engine 20 is a high-bypass geared aircraft engine. In a further example, the gas turbine engine 20 bypass ratio is greater than about six (6:1). The geared architecture 48 can include an epicyclic gear train, such as a planetary gear system or other gear system. The example epicyclic gear train has a gear reduction ratio of greater than about 2.3:1, and in another example is greater than about 2.5:1. The geared turbofan enables operation of the low spool 30 at higher speeds that can increase the operational efficiency of the LPC 44 and LPT 46 and render increased pressure in a fewer number of stages.

A pressure ratio associated with the LPT 46 is pressure measured prior to the inlet of the LPT 46 as related to the pressure at the outlet of the LPT 46 prior to an exhaust nozzle of the gas turbine engine 20. In one non-limiting embodiment, the bypass ratio of the gas turbine engine 20 is greater than about ten (10:1), the fan diameter is significantly larger than that of the LPC 44, and the LPT 46 has a pressure ratio that is greater than about five (5:1). It should be understood, however, that the above parameters are only exemplary of one embodiment of a geared architecture engine and that the present disclosure is applicable to other gas turbine engines including direct drive turbofans.

In one embodiment, a significant amount of thrust is provided by the bypass flow path B due to the high bypass ratio. The fan section 22 of the gas turbine engine 20 is designed for a particular flight condition—typically cruise at about 0.8 Mach and about 35,000 feet (10,688 meters). This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $(\text{"T"}/518.7)^{0.5}$, where "T" represents the ambient temperature in degrees Rankine. The Low Corrected Fan Tip Speed according to one non-limiting embodiment of the example gas turbine engine 20 is less than about 1150 feet per second (351 meters per second).

Figure 2:
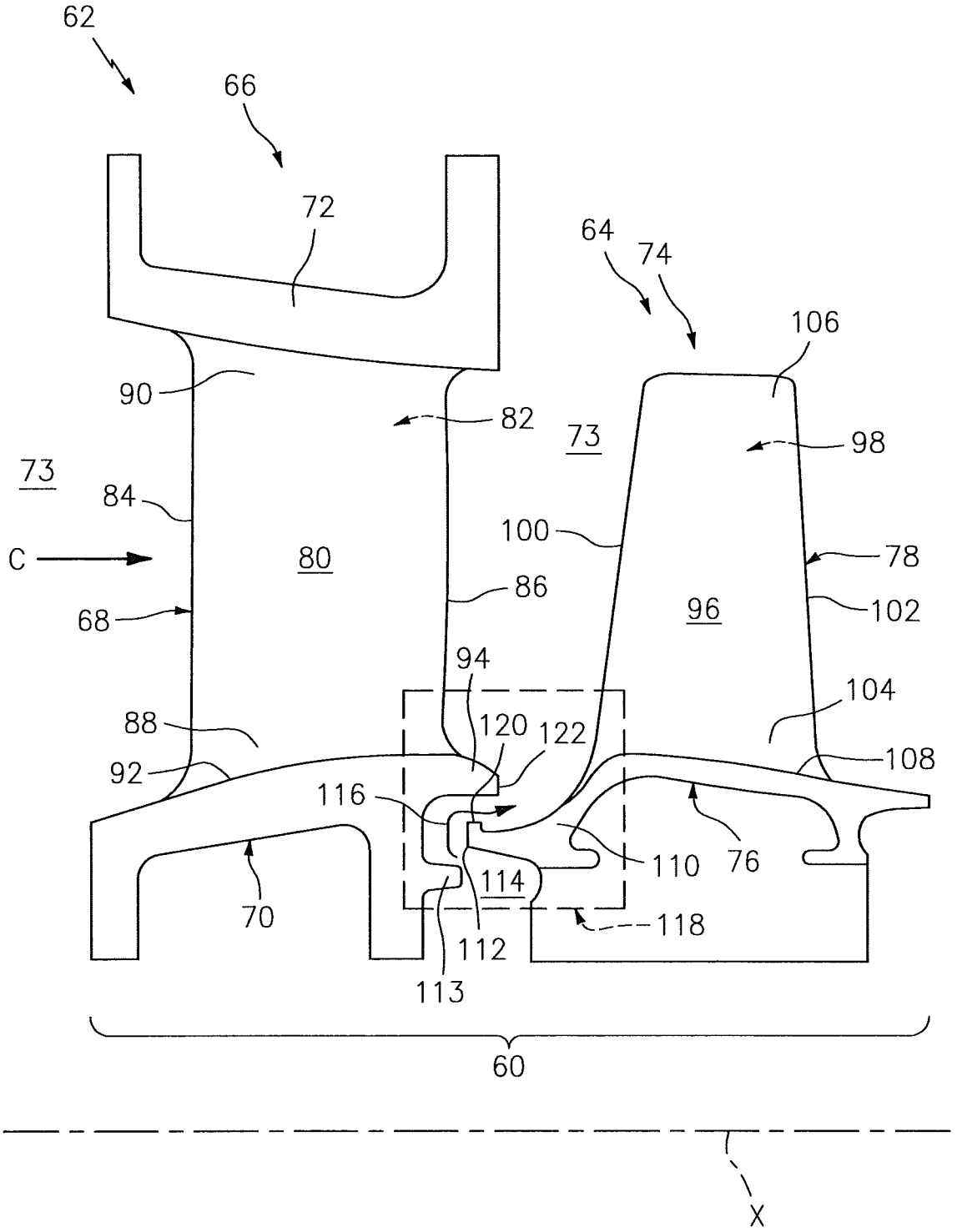
FIG. 2 is a side view of a turbine or compressor stage for a gas turbine engine.

Referring to FIG. 2, a single turbine airfoil stage 60 of multiple stages of the HPT 54 is illustrated. Airfoil stage 60 includes a leading or upstream airfoil or static vane assembly 62 and an axially adjacent and downstream airfoil or rotating blade assembly 64. The vane assembly 62 has a plurality of circumferentially spaced vanes 66 (with respect to engine axis X) each having at least one airfoil 68 that projects radially between and forms into a radially inward platform 70 and a radially outward platform 72 that define in-part an annular core flowpath 73. Although not illustrated, when stage 60 is assembled, the plurality of inward and outward platforms 70, 72 form respective rings that are centered about the engine axis X and each spanning axially between upstream and downstream rims of the respective rings.

Similarly, the blade assembly 64 of the airfoil stage 60 includes a plurality of circumferentially spaced blades 74 each having a platform 76 and an airfoil 78 forme to and projecting radially outward from the platform 76. The airfoils 78 are disposed in the core flowpath 73 and the platforms 76 define an radially inward boundary of the core flowpath 73. When fully assembled, the plurality of platforms 76 form a ring centered about engine axis X, spanning axially between upstream and downstream rims of the ring. In the present example, the airfoils 68 of the vanes 66 are positioned upstream of the airfoils 78 of the blades along working core airflow C that may be, for example, air, steam or combustion gas. Conversely, airfoils 68 may be position downstream from airfoils 78 (not illustrated). It is further contemplated and understood that the airfoil stage 60 may be part of the LPT 46, the LPC 44 or the HPC 52.

Each airfoil 68 of the vanes 66 has and carries a concave pressure surface 80 (front) and an opposite convex suction surface 82 (back). Pressure and suction surfaces 80 and 82 generally extend axially from a leading edge 84 to a trailing edge 86 of the vane airfoil 68, and radially from an inner diameter (ID), root, section 88 (adjacent ID vane platform 70), to an outer diameter (OD) section 90 (adjacent OD vane platform 72). The ID vane platform 70 carries a radially outward facing surface 92 that defines in-part the core flowpath 73, and further has a downstream projecting portion 94 generally disposed downstream of the ID root section 88 of the vane airfoil 68.

Each airfoil 78 of the blade 74 has and carries a convex suction surface 96 (front) and an opposite concave pressure surface 98 (back). Suction and pressure surfaces 96 and 98 generally extend axially from a leading edge 100 to a trailing edge 102 of the airfoil 78, and radially from an ID, root, section 104 (adjacent blade platform 76), to an OD, distal, tip section 106. Depending on configuration, the tip section 106 may be shrouded, or positioned with rotational clearance to a stationary engine casing structure or blade outer air seal (BOAS).

The blade platform 76 carries a radially outward facing face 108 that generally defines, at least in-part, the core flowpath 73, and further has an upstream segment or 'angel wing' 110 that projects in an upstream direction to a distal end 112. At least a portion of the upstream segment 110 axially overlaps the downstream portion 94 of the ID vane platform 70 and such that the distal end 112 of the upstream segment 110 is spaced radially inward from the downstream portion 94.

A cooling cavity 114 is generally defined between and by the downstream portion 94 of the ID vane platform 70 and the upstream segment 110 of the blade platform 76. Cooling air (see arrow 116) may generally flow radially outward to cool surrounding components where it is then expelled into the core flowpath 73. The ID vane platform 70 may be of a 'fish-mouth' orientation with an additional rearward projecting member 113 generally located in the cooling cavity 114 and positioned such that the upstream segment 110 of the blade platform 76 is radially space between the downstream portion 94 and the member 113.

The airfoil stage 60 further includes a rim seal assembly 118 to control the flow of cooling air 116 and minimize or eliminate ingestion of core airflow C from the core flowpath 73 and into the cooling cavity 114. Rim seal assembly 118 includes the downstream portion 94 of the ID vane platform 70, the upstream segment 110 of the blade platform 76 and a circumferentially continuous nub 120. The surface 92 of the ID vane platform 70 at the downstream portion 94 slopes radially inward as the portion 94 projects in a downstream direction to a distal end 122 of the portion 94. The slope may generally have a convex profile or contour, and as a result of this slope, the distal end 122 of the portion 94 may generally be located radially inward from a portion of the face 108 of the blade platform 76 generally not carried by the upstream segment 110.

The upstream segment 110 of the blade platform 76 projects axially upstream and radially inward such that the upstream segment 110, in-part, axially overlaps and is spaced radially inward from at least a part of the downstream portion 94 of the vane platform 70. The portion of the face 108 carried by the upstream segment 110 may be sloped radially inward as the segment projects in an upstream direction. The sloping face 108 may generally have a concave profile or contour at the upstream segment 110 location.

The nub 120 projects radially outward generally from the face at the distal end 112 of the upstream segment 110. To maintain the expulsion of cooling, purge air 116 out of the cooling cavity 114 and into the core flowpath 73, the nub 120 is spaced radially inward from the downstream portion 94 of the ID vane platform 70. With the airfoil or blade assembly 64 fully assembled, the nubs 120 from each blade 74 will generally form a continuous rim located concentrically to the axis X. Although the nub 120 may be described as circumferentially continuous, it is understood that the term "continuous" does not eliminate and thus may include seams or gaps within the circumferentially continuous nub, with such seams generally being located between the circumferentially arranged platforms 76 of the blades 74. The sloping downstream portion 94 and the nub 120 projecting from the upstream segment 110, together, function to reduce losses in the flow transition from vane assembly 62 to the blade assembly 64 of each stage 60, and to provide additional improvements in turbine performance and cooling efficiency.

Figure 3A:
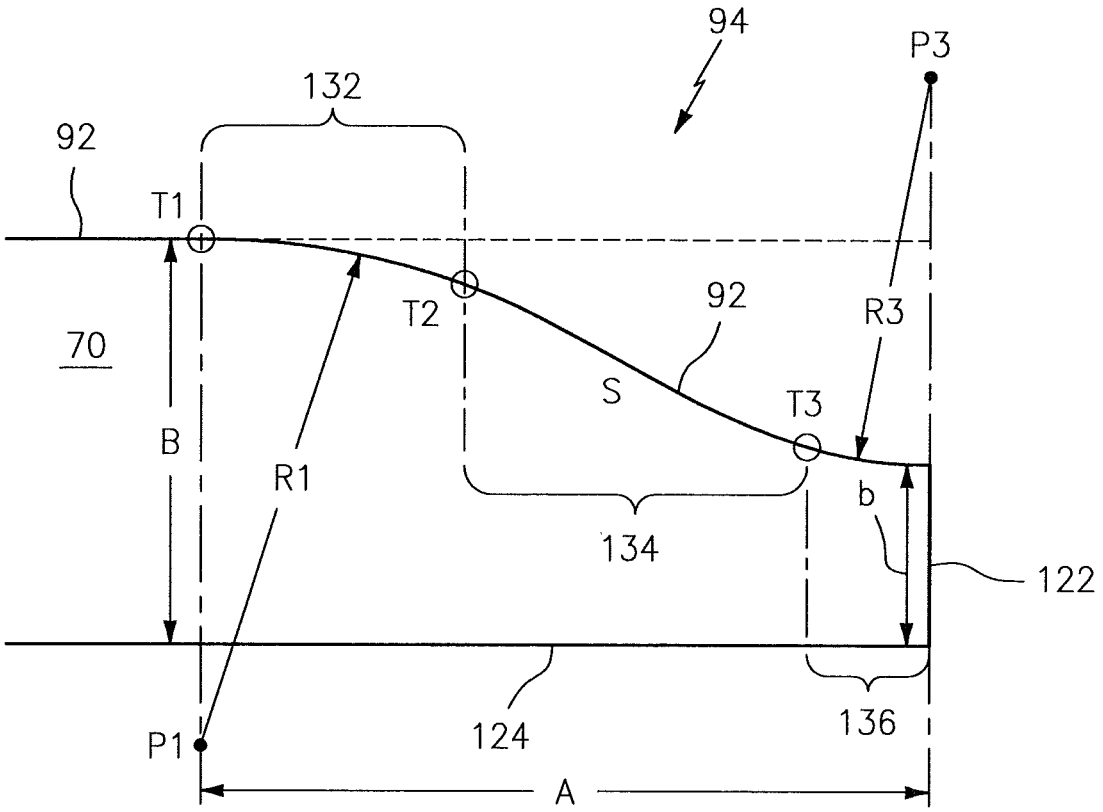
FIG. 3A is a schematic diagram illustrating an airfoil platform with an arcuate flowpath contour along the trailing edge.

Referring to FIG. 3A, a schematic diagram illustrates an example of a three-part arcuate-spline-arcuate geometry along the downstream portion 94 of the ID vane platform 70. The surface 92 at the downstream portion 94 extends axially from transition T1 to a downstream (trailing) edge or end 122 of downstream portion 94, and radially between surface 92 and an opposite undersurface 124 of the platform 70. The axial length (see arrow A) of the platform downstream portion 94 is defined between transition T1 and downstream end 122. The radial height or thickness (see arrow B) is defined between surface 92 and undersurface 124, as measured along a vertical or radial direction at transition (or tangency point) T1. In this particular configuration, the downstream end 122 of the platform downstream portion 94 is formed as a substantially straight or linear portion, with a vertical thickness or radial height (see arrow b) measured radially between the surface 92 and the undersurface 124 at the end 122 that is less than thickness B.

The flowpath contour of platform downstream portion 94 can be divided into three parts or regions 132, 134 and 136, extending axially through transitions T1, T2 and T3 to downstream end 122 of the platform 70. In the configuration of FIG. 3A, for example, first (upstream) flowpath region 132 has a convex curvature extending from transition T1 to transition T2; second (intermediate) flowpath region 134 has a compound curvature or spline contour extending from transition T2 to transition T3; and, third (downstream) flowpath region 136 has concave curvature extending from transition T3 to downstream end 122 of the platform downstream portion 94.

First transition T1 may be defined as a change in curvature or concavity (second derivative) along surface 92, at the upstream end of first region 132. Second transition T2 may be defined as a change in curvature or concavity between first region 132 and second region 134, and third transition T3 may be defined as a change in curvature or concavity between second region 134 and third region 136. For example, the change in curvature or concavity may be from zero to a positive definite or negative definite value. Alternatively, the change may be from a positive definite or negative definite value to zero, or between positive definite and negative definite values, in either order.

Depending on configuration, the slope (first derivative) may be continuous across one or more transitions T1, T2 and T3, so that the upstream and downstream flowpath regions have matching slope (or slopes) at one or more transitions T1, T2 and T3. In these configurations, the second derivative (curvature of concavity) may be continuous across transitions T1, T2 and T3. Alternatively, any one or more of transitions T1, T2 and T3 may be defined at a change in slope (first derivative), and the second derivative may not necessarily be continuous at each transition T1, T2, T3, but instead may be discontinuous at one or more of transitions T1, T2 and T3.

In one particular example of a three-part contour, first (upstream) region 132 of the platform downstream portion 94 is formed as an arcuate segment with substantially convex radius of curvature R1, extending along flowpath surface 92 of the platform 70 from transition T1 to second region 134 at transition T2. Second (intermediate) region 134 is formed as a smooth, continuous segment such as a spline, extending from first region 132 at transition T2 to third region 134 at transition T3. Third (downstream) region 134 is formed as an arcuate segment with substantially concave radius of curvature R2, extending from second region 134 at transition T3 to downstream end 122 of the platform downstream portion 94.

Along first contour or flowpath region 132, convex radius of curvature R1 may be defined from point P1, vertically below and radially inward of transition T1. Along third contour or flowpath region 136, concave radius of curvature R3 may be defined from point P3, vertically above and radially outward of downstream end 122 of platform downstream portion 94. In some conventions, convex curvature R1 is considered positive and concave curvature R3 is considered negative, but positive or absolute values may also be used, or the sign convention may be reversed.

A spline contour or other continuous curvature defines an aerodynamically smooth flowpath along second (intermediate) region 134, between first (upstream) region 132 and third (downstream) region 136. In particular, the spline contour or other continuous curvature may define a substantially continuous slope (first derivative) through transition T2, between convex region 132 and intermediate region 134, and through transition T3, between intermediate region 134 and concave region 136.

The overall dimensions of platform downstream portion 94 may vary from application to application, along with the contours defined along flowpath surface 92. Radial height (or platform thickness) B, for example, typically scales with airfoil dimensions and engine size. Vertical height b of downstream end 122, in turn, may scale with platform thickness B, for example between 10% and 50% (that is, 0.1 B≤b≤0.5 B). Alternatively, vertical height b of downstream end 122 ranges up to 75% of platform thickness B (that is, b≤0.75B).

Axial length A of platform downstream portion 94 also scales with platform thickness B, in order to provide suitable contour lengths along flowpath regions 132, 134 and 136. For example, axial length A may have an upper limit of ten times platform thickness B (A≤10 B), and a lower limit of two to five times platform thickness B (A≥2.0 B, or A≥5.0 B). Axial length A of platform downstream portion 94 may also fall into a narrower range, for example three to five times platform thickness B (3.0 B≤A≤5.0 B), or about four times platform thickness B (A≈4.0 B), within a tolerance of 2-5% of platform thickness B, or 10% of platform thickness B.

Together, flowpath contour regions 132, 134 and 136 span 100% of axial length A, but the individual lengths may vary. For example, regions 132, 134 and 136 may each span at least 10% of axial length A, so each individual region 132, 134 and 136 varies between 10% and 80% of axial length A. Alternatively, the contours may be somewhat more evenly divided, for example with individual regions 132, 134 and 136 spanning 20-50% of axial length A, or 30-40% of axial length A, and summing to 100% of axial length A.

Figure 3B:
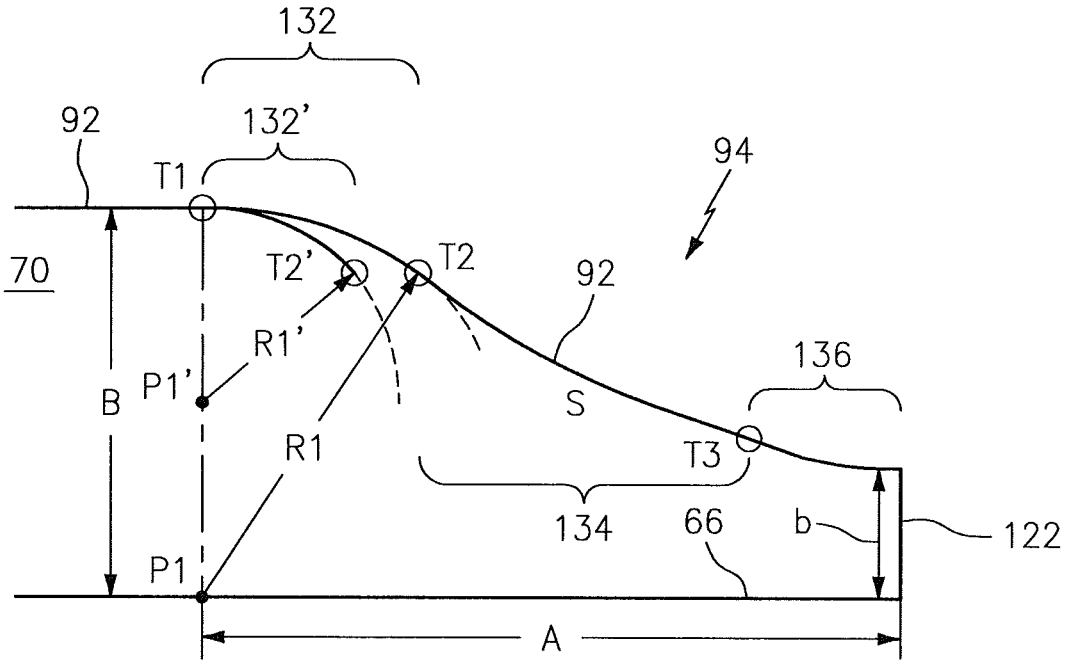
FIG. 3B is a schematic diagram illustrating different curvatures for the arcuate flowpath contour.

Referring to FIG. 3B, a schematic diagram illustrates different curvatures for upstream convex segments 132 and 132' of platform downstream portion 94. Different radii of curvature R1, R1' may be defined at different points P1, P1', positioned variously with respect to upstream contour transition T1. In addition, the different radii of curvature R1, R1' may correspond to flowpath regions 132, 132' having different axial lengths, as defined from upstream transition T1 to intermediate transitions T2, T2'.

In particular examples, radius of curvature R1 may be approximately R1≈B, for example as defined at point P1, with first contour region 70 extending from upstream transition T1 to intermediate transition T2. Alternatively, radius of curvature R1' may be approximately R1'≈B/2, as defined at point P1', and first contour region 132 may extend from transition T1 to transition T2'.

More generally, convex radius of curvature R1 (or R1') may vary from one-quarter to twice radial height B; that is, with 0.25 B≤R1 (or R1')≤2.0 B. Radius R1 (or R1') may also be expressed in terms of elliptical rather than circular curvature, for example with a ratio of semi-major to semi-minor axis in the range of 1:1 to 4:1, or in another similar or substantially equivalent form. In some of these applications, radius of curvature R1 may vary along upstream flowpath region 132, for example within the range 0.25 B≤R1 (or R1')≤2.0 B between transition T1 and transition T2.

The curvature of downstream region 136 also varies, for example with convex radius of curvature 0.25 B≤R3≤2.0 B. Alternatively, downstream region 136 may have higher radius of curvature R3≥2.0 B, R3≥5.0 B or R3≥10.0 B. In some designs, radius of curvature R3 is arbitrarily high and third flowpath region 136 is substantially straight, for example as shown in FIG. 4A or FIG. 4B, below.

Figure 5B:
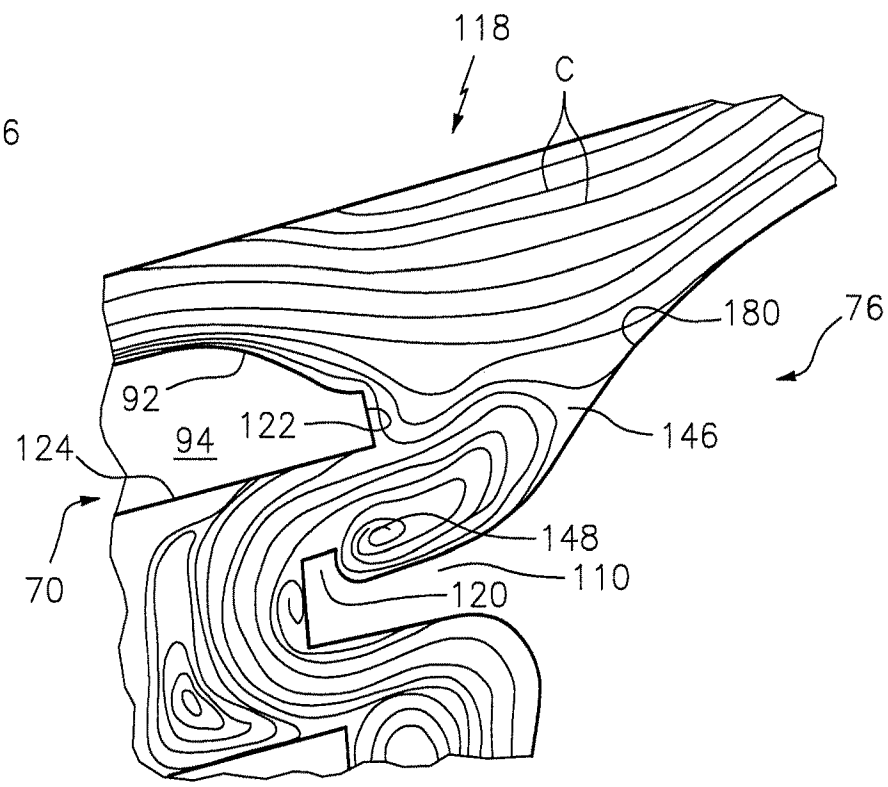
FIG. 5B is a schematic diagram illustrating working core flow along a contoured platform trailing edge.

The curvature of intermediate or spline region 134 varies with the corresponding curvatures of upstream (convex) region 132 (or 132') and downstream (concave or linear) region 136, in order to match the slope of the flowpath contour across transitions T2 and T3. More generally, the shape of the flowpath contour in intermediate region 134 is selected together with the corresponding flowpath contours in upstream and downstream regions 132 (or 132') and 136, in order to improve flow efficiency along full axial length A of platform downstream portion 94. The flowpath contours along regions 132 (or 132'), 134 and 136 of platform downstream portion 94 are also selected to reduce losses and improve cooling efficiency downstream of the end 122, in order to improve turbine performance in the downstream rotor stage, as shown in FIG. 5B.

Figure 4A:
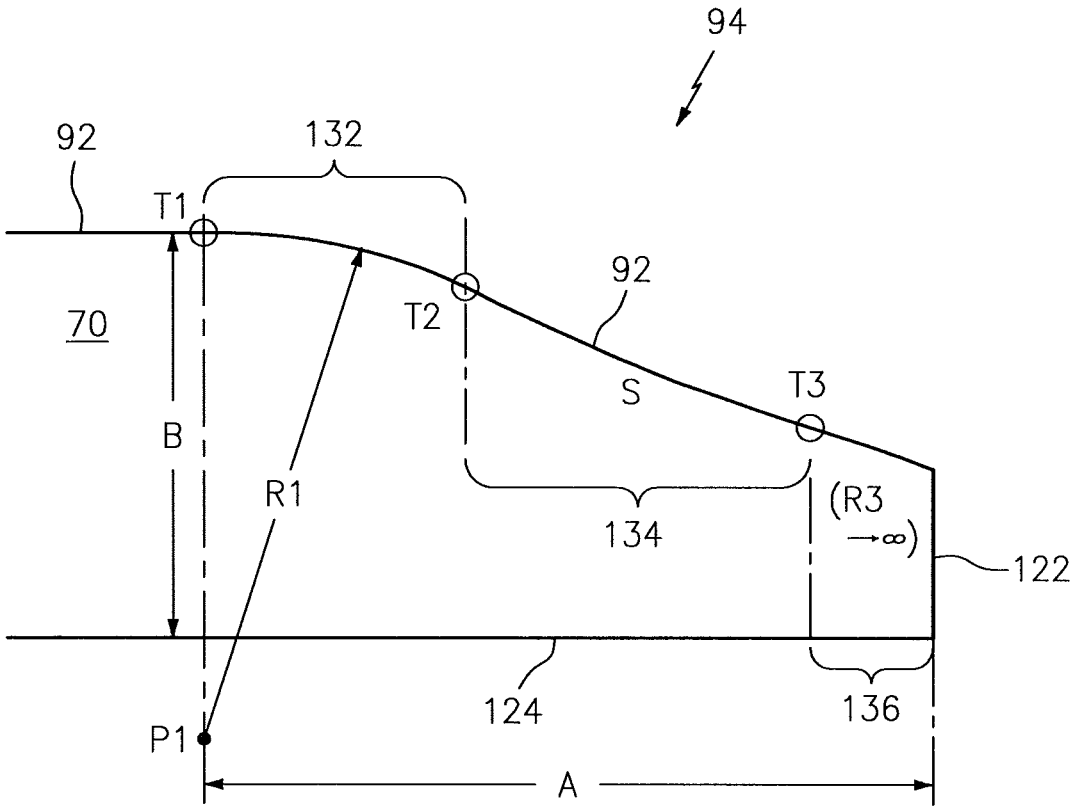
FIG. 4A is a schematic diagram illustrating an airfoil platform with arcuate and linear flowpath contours along the trailing edge.

Referring to FIG. 4A, a schematic diagram illustrates a linear geometry for downstream region 136 of platform downstream portion 94. The radius of curvature may be arbitrarily high in downstream region 136, between transition T3 and downstream end 122 of ID platform 70 (for example, in a limit R3 goes to an arbitrarily high value, represented as "≥"). In this configuration, intermediate spline region 134 may be substantially linear across transition T3 to downstream region 136, and have curvature from transition T3 to transition T2 in order to match the slope of upstream (convex) region 132.

Figure 4B:
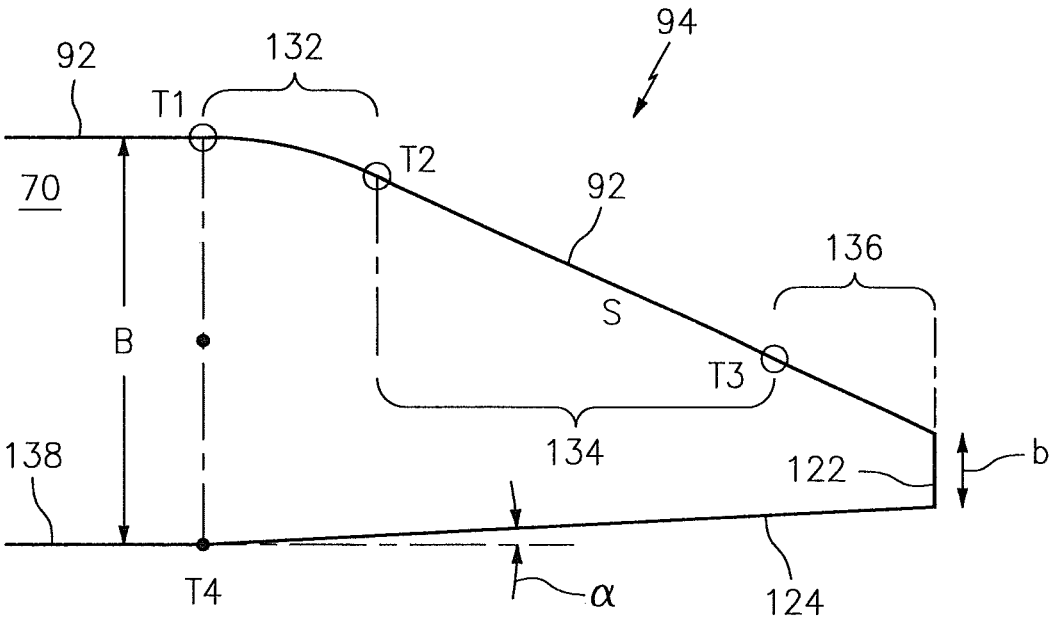
FIG. 4B is a schematic diagram illustrating an airfoil platform with an angled undersurface along the trailing edge.

Referring to FIG. 4B, a schematic diagram illustrates an angled geometry for undersurface 124 of the platform downstream portion 94. In this configuration, undersurface 124 of platform downstream portion 94 makes angle α at transition T4 with respect to upstream undersurface 138, for example at least two degrees (α≥2°), in order to increase or decrease height or thickness b along end 122 of ID platform 70.

In addition, height b of end 122 and the slope of substantially linear downstream region 136 may also be selected to match the slope and position of upstream (convex) region 132 at transition T2, as shown in FIG. 4B. In this configuration, the flowpath contour may be substantially straight or linear from transition T2 through intermediate region 134 to transition T3, and from transition T3 through downstream region 136 to the downstream end 122 of the platform downstream portion 94.

The configuration of platform 70 thus varies along trailing edge region 136, as described above, and as shown in the figures. The contour of flowpath 73, moreover, is not limited to the particular variations that are shown, and may also include different combination of the different features that are described. In particular, flowpath regions 132, 134 and 136 may have different arcuate, splined, convex, concave and linear contours, in combination with different straight and angled geometries for undersurface 124, and different heights b along downstream end 122 of the platform downstream portion 94, with different axial lengths A.

Figure 5A:
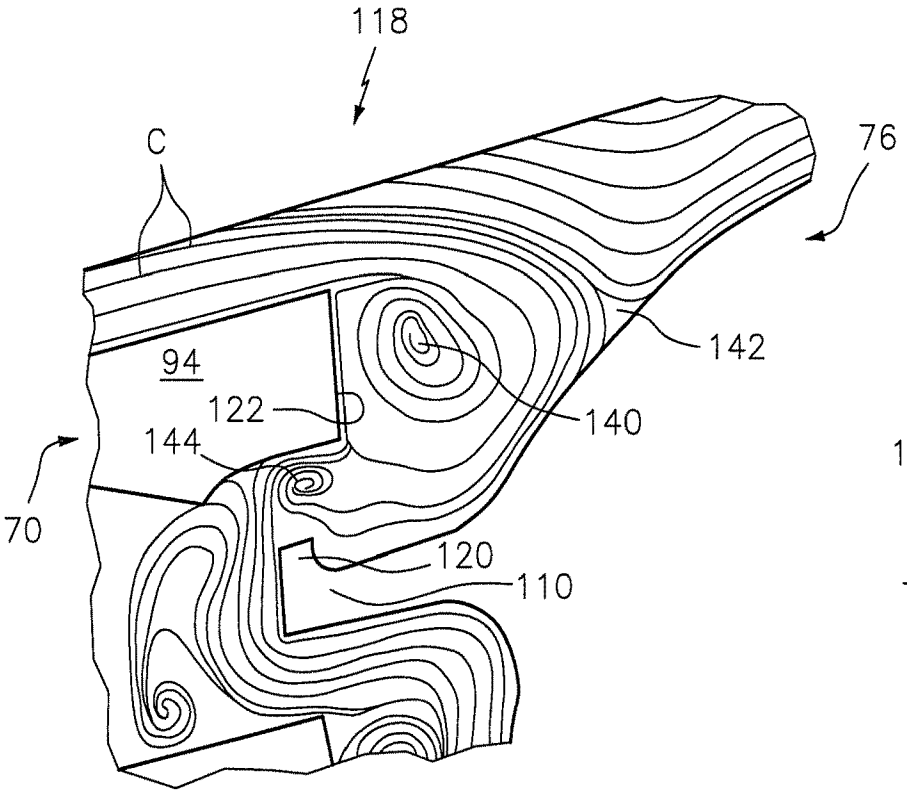
FIG. 5A is a schematic diagram illustrating working core flow along an airfoil platform trailing edge.

Referring to FIG. 5A, a schematic diagram of a first example of the rim seal assembly 118 illustrates the working core flow C along a downstream portion of the vane platform 70, but without the sloping feature of the surface 92 previously described. The novel nub 120 of the upstream segment 110 of the blade platform 76 is shown. Depending on the application, the working fluid flow C in FIG. 5A may be represented either in transient or steady-state terms, for example via streamlines or streaklines generated by computational fluid dynamics (CFD) or other simulation methods. The platform downstream portion 94 in this example generates a relatively large circulation or vortex flow zone 140, bounded between a stagnation point 142 and the downstream end 122 of the platform downstream portion 94, and by the nub 120 and upstream segment 110 of the blade platform 76. In addition, however, a secondary vortex 144 forms between the nub 120 and the platform downstream portion 94 that may potentially result in hot gas ingestion and some obstruction of cooling fluid flow to the downstream stage. Although the nub 120 (and without a sloping surface 92) reduces hot gas ingestion when compared to more traditional designs, any propensity to ingest requires increased purge cooling flow to maintain component life, resulting in a loss of turbine efficiency and decreased cycle performance.

Referring to FIG. 5B, a schematic diagram of a second example of the rim seal assembly 118 illustrates the working fluid flow C along the platform downstream portion 94 of the vane platform 70 and with the sloping surface 92 previously described. In this example, the contoured flowpath surface 92, acting with the nub 120 further improves flow efficiency along the platform downstream portion 94, and in the transition zone between the vane and blade airfoils 68, 78 (see FIG. 2). In particular, contoured surface 92 carried by the downstream end portion 94 results in substantially less circulation between the downstream end 122 of the platform downstream portion 94 and a stagnation point 146, for reduced losses and improved efficiency. In addition, stagnation point 146 is translated upstream, toward downstream end 122 of platform downstream portion 94, and a secondary vortex 148 is translated downstream and radially inward to a position adjacent the upper face 108 carried by the upstream segment 110 of the blade platform 76.

Undersurface 124 carried by the platform downstream portion 94 may also be angled upward or downward, as described above, in order to increase or decrease the spacing between the upstream segment 110 of the blade platform 76) and the downstream portion 94 of the vane platform 70. Whether considered alone or in combination with the shift of secondary vortex 148 away from the downstream end 122 of the downstream portion 94, and the other flow effects described above, this example further improves cooling efficiency by reducing mixing and increasing cooling flow coverage along the core flowpath 73 proximate or adjacent to the downstream blade platform 76.

While the invention is described with reference to exemplary embodiments, it will be understood by those skilled in the art that various changes may be made and equivalents may be substituted without departing from the spirit and scope of the invention. In addition, different modifications may be made to adapt the teachings of the invention to particular situations or materials, without departing from the essential scope thereof. For example, the platform 70 of the vane 66 and related features may be interchanged with the platform 76 of the blade 74 and related features, thus placing the blade 74 upstream of the vane 66 for each airfoil stage 60. The invention is thus not limited to the particular examples disclosed herein, but includes all embodiments falling within the scope of the appended claims

The invention claimed is:

1. An airfoil stage of a turbine engine comprising:

an upstream airfoil assembly defined about an axis and including a first platform having a downstream portion carrying a surface facing radially outward and an undersurface opposed to the surface, and defining in-part a core flowpath, and wherein the surface slopes radially inward as the downstream portion projects downstream to a distal end of the downstream portion; and a downstream airfoil assembly disposed axially adjacent to the upstream airfoil assembly, the downstream airfoil assembly including a second platform having an upstream segment projecting upstream and comprising a distal end opposite the second platform, the second platform having a nub projecting radially outward from the upstream segment; and wherein the nub is axially aligned radially inward from the downstream portion; and wherein the surface is defined by a transition point corresponding to a change in curvature at an upstream end of the downstream portion; and wherein the transition point is defined by a radius of curvature; and wherein the radius of curvature is defined from a point that is at a common axial location as the transition point and radially inward of the transition point; and wherein the downstream portion has a radial thickness defined between the surface and the undersurface at the transition point; and wherein the radius of curvature is greater than or equal to one-quarter of the radial thickness and less than or equal to two times the radial thickness;

wherein the upstream airfoil assembly further comprises a projecting member projecting axially, from the first platform at a position radially inward of the upstream segment, toward the second platform, the projecting member comprising a distal end opposite the first platform and configured to direct cooling air toward the core flowpath, wherein the distal end of the projecting member is axially upstream of the distal end of the upstream segment, and wherein the upstream airfoil assembly is a blade assembly and the downstream airfoil assembly is a vane assembly.

2. The airfoil stage set forth in claim 1, wherein the nub is spaced radially inward from the downstream portion.

3. The airfoil stage set forth in claim 1, wherein the nub is disposed axially upstream from the distal end.

4. The airfoil stage set forth in claim 1, wherein the upstream and downstream airfoil assemblies are in rotational movement to one-another.

5. The airfoil stage set forth in claim 1, wherein the downstream portion and the upstream portion generally define, at least in-part, a cavity for the flow of cooling air into the core flowpath.

6. The airfoil stage set forth in claim 1, wherein the surface has at least in-part a convex contour, and wherein the upstream segment carries a face facing radially outward, spaced from the downstream portion, having at least in-part a concave contour, and wherein the nub projects radially outward from the face.

7. The airfoil stage set forth in claim 1, wherein the downstream portion has a second radial thickness defined between the surface and the undersurface at the distal end; and wherein the second radial thickness is greater than or equal to one-tenth of the radial thickness; and wherein the second radial thickness is less than or equal to seventy-five hundredths of the radial thickness.

8. The airfoil stage set forth in claim 1, wherein the surface is defined by a first region, a second region, and a third region; and wherein the first region is defined between the transition point and a second transition point that is downstream of the transition point; and wherein the second region is defined between the second transition point and a third transition point that is downstream of the second transition point; and wherein the third region is defined between the third transition point and the distal end; and wherein the second transition point is defined by a change in curvature between the first region and the second region; and wherein the third transition point is defined by a change in curvature between the second region and the third region.

9. The airfoil stage set forth in claim 1, wherein the undersurface slopes radially outward as the undersurface projects downstream to the distal end.

10. The airfoil stage set forth in claim 1, wherein the downstream portion and the distal end form a corner at the distal end.

* * * * *